US009769901B1

(12) United States Patent
Vaughan et al.

(10) Patent No.: US 9,769,901 B1
(45) Date of Patent: Sep. 19, 2017

(54) VARIABLE BLEEDER CIRCUIT

(71) Applicant: Power Integrations, Inc., San Jose, CA (US)

(72) Inventors: Peter Vaughan, Los Gatos, CA (US); Christian Pura Angeles, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 2 days.

(21) Appl. No.: 15/182,471

(22) Filed: Jun. 14, 2016

(51) Int. Cl.
*H05B 37/02* (2006.01)
*H05B 33/08* (2006.01)

(52) U.S. Cl.
CPC ..... *H05B 33/0884* (2013.01); *H05B 33/0815* (2013.01); *H05B 33/0845* (2013.01)

(58) Field of Classification Search
CPC ..... H05B 33/0815; H05B 33/0845; H05B 33/0809; H05B 37/0263
USPC ..... 315/186, 287, 294, 297
See application file for complete search history.

(56) References Cited

U.S. PATENT DOCUMENTS 8,581,498 B1 * 11/2013 Cheung ..... H05B 33/0815 315/119
8,692,479 B2 * 4/2014 Mercier ..... H05B 33/0809 315/185 R
9,119,254 B2 * 8/2015 Lee ..... H05B 33/0815
9,468,048 B2 * 10/2016 Eom ..... H05B 33/0815
2011/0291583 A1 * 12/2011 Shen ..... H05B 33/0815 315/287
2012/0126714 A1 * 5/2012 Deppe ..... H05B 33/0815 315/192
2013/0169177 A1 * 7/2013 Liao ..... G05F 1/10 315/200 R
2014/0159616 A1 * 6/2014 Wang ..... H05B 33/0845 315/307
2016/0081151 A1 * 3/2016 Wang ..... H05B 33/0815 315/186

* cited by examiner

*Primary Examiner* — Tung X Le
(74) *Attorney, Agent, or Firm* — Christensen O'Connor Johnson Kindness PLLC

(57) ABSTRACT

A bleeder circuit includes an input current sense circuit, coupled to one of first and second input terminals of a driver circuit, to output a bleeder on/off signal in response to an input current through the first and second input terminals of the driver circuit. A variable current circuit is coupled between the first and second input terminals of the driver circuit and coupled to the input current sense circuit. The variable current circuit is coupled to conduct a bleeder current between the first and second input terminals in response to the bleeder on/off signal. A current scaling circuit is coupled to the variable current circuit to output a current scale signal which is received by the variable current circuit in response to a shutdown signal. The shutdown signal is representative of a conduction angle.

30 Claims, 8 Drawing Sheets

VARIABLE BLEEDER CIRCUIT

BACKGROUND INFORMATION

Field of the Disclosure

The present invention relates generally to power converters. More specifically, examples of the present invention are related to lighting systems including dimming circuitry.

Background

Electronic devices use power to operate. Power is generally delivered through a wall socket as high voltage alternating current (ac). A device typically referred to as a power converter can be utilized in lighting systems to convert the high voltage ac input into a well regulated direct current (dc) output through an energy transfer element. Switched mode power converters are commonly used to power many of today's electronics due to their high efficiency, small size, and low weight. During operation, a switch included in the power converter is used to provide the desired output by varying (1) the duty cycle (the ratio of the on time of the switch to the total switching period), (2) the switching frequency, or (3) the number of pulses per-unit-time of the switch.

In one type of dimming for lighting applications, a dimmer circuit disconnects a portion of the ac input voltage to limit the amount of voltage and current supplied to an incandescent lamp. This is generally known as phase dimming because it is often convenient to designate the position of the missing voltage in terms of a fraction of the ac input voltage (as measured in degrees). In general, the ac input voltage is a sinusoidal waveform and the period of the ac input voltage is referred to as a full line cycle.

While phase dimming may work well in some applications (for example, with incandescent lamps), in other applications, phase dimming may be less desirable due to the stringent power requirements of modern electronic devices.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
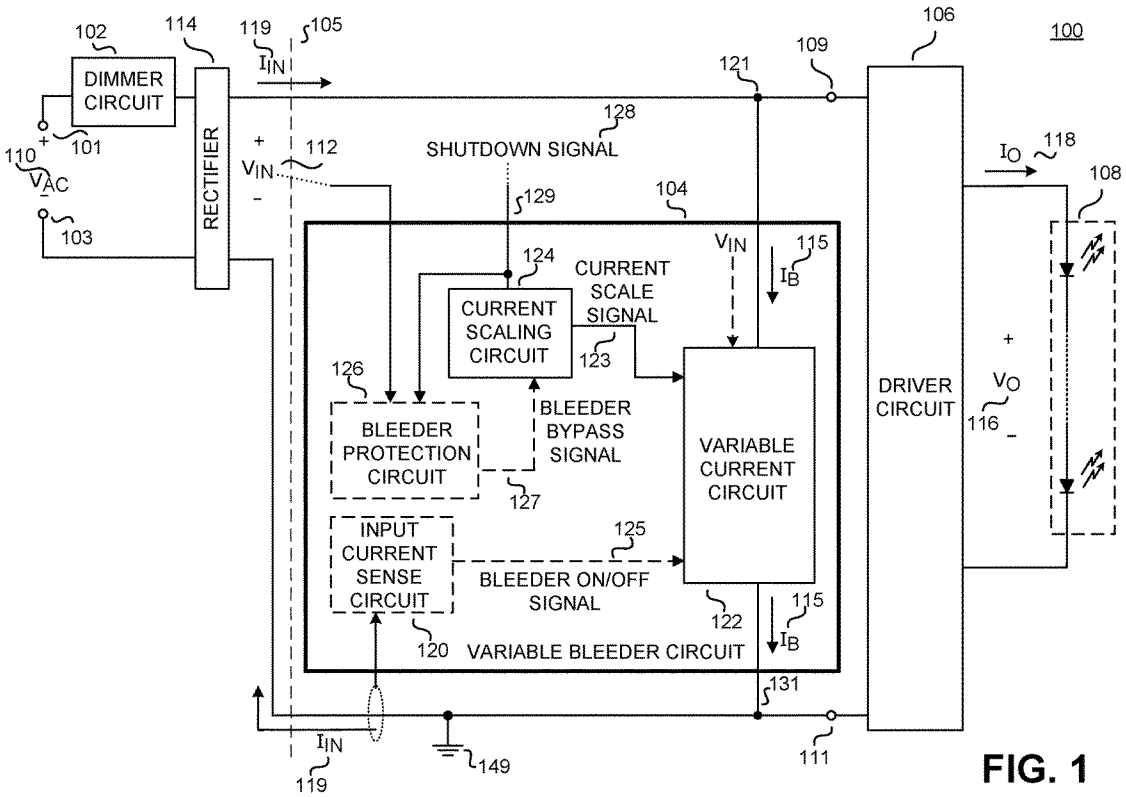
FIG. 1 is a functional block diagram of one example of a lighting system including an example variable bleeder circuit and driver circuit, in accordance with the teachings of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring certain aspects.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combination and/or subcombination in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes only and are not necessarily drawn to scale. Furthermore, embodiments/examples in this application refer to different pieces of circuitry responding to a "logic high" or "logic low" signal in a particular way; however, one skilled in the art will appreciate that the same piece of circuitry may be configured to respond the same way to the opposite signal (e.g., a piece of circuitry that turns on in response to a logic high signal, may be configured to turn on in response to a logic low signal or vice versa).

Although phase angle dimming works well with incandescent lamps, certain types of phase angle dimming may create problems for light emitting diode (LED) systems driven by a switched mode power converter. Unless a power converter is specially designed for an LED lamp, a phase angle dimmer circuit may produce unacceptable results such as flickering or "pop-on" of the LED system. In some instances, flickering may be attributed to a TRIAC dimmer circuit losing power (and failing to function) as a result of the low-power requirement of the LED system. Pop-on arises when the dimmer circuit is set above its existing state to produce light output at initial turn-on; the difference between the initial turn-on setting and the existing setting may be referred to as "pop". Pop-on may reduce the overall efficiency of the lighting system. Accordingly, it is generally advantageous to have a circuit that eliminates flicker and pop-on in LED lighting systems. As will be shown, power converters utilizing bleeder circuits may help mitigate these issues.

FIG. 1 is a functional block diagram of one example of a lighting system 100 including an example variable bleeder circuit 104. As shown, lighting system 100 includes a driver circuit 106 coupled to drive a load 108 with an output voltage $V_O$ 116 and an output current $I_O$ 118. In one example, driver circuit 106 includes a switched mode power converter (not shown), and load 108 includes one or more light emitting diodes (LEDs). Driver circuit 106 has an input with a first input terminal 109 and a second input terminal 111; both terminals are coupled to an input 105 to receive an input voltage $V_{IN}$ 112 and an input current $I_{IN}$ 119. In one example, input voltage $V_{IN}$ 112 is received from a rectifier circuit 114 and a dimmer circuit 102. The dimmer circuit 102 is coupled to receive an ac line voltage $V_{AC}$ 110 between terminals 101 and 103. Dimmer circuit 102 may be external to driver circuit 106. The input voltage $V_{IN}$ 112 is positive with respect to the input return 149. In one example, dimmer circuit 102 may be a TRIAC dimmer circuit or a thyristor dimmer circuit, which may add high frequency transitions to input voltage $V_{IN}$ 112 by removing portions of the ac line voltage $V_{AC}$ 110.

Lighting system 100 also includes variable bleeder circuit 104 including a first terminal 121 coupled to the first input terminal 109 of driver circuit 106, and a second input terminal 131 coupled to the second input terminal 111 of driver circuit 106. The variable bleeder circuit 104 includes a third terminal 129 coupled to receive the shutdown signal 128. In various examples, variable bleeder circuit 104 may be implemented as a monolithic integrated circuit, as discrete electrical components, or as a combination of discrete and integrated components, in accordance with the teachings of the present invention.

Variable bleeder circuit 104 includes a variable current circuit 122, and a current scaling circuit 124. The variable bleeder circuit 104 also includes an optional input current sense circuit 120 and an optional bleeder protection circuit 126. Both of these optional features will be discussed here, in connection with FIG. 1; however, embodiments without these optional features will be discussed in greater detail in connection with FIG. 5. In some examples, the input current sense circuit 120 may be combined with the variable current circuit 122. If present, the input current sense circuit 120 may be coupled between first input terminal 109 and second input terminal 111 of driver circuit 106.

The variable current circuit 122 is coupled to conduct the bleeder current $I_B$ 115 between first input terminal 109 and second input terminal 111. In the depicted example, the bleeder on/off signal 125 and the current scale signal 123, control the amount of bleeder current $I_B$ 115 through variable current circuit 122. If both the bleeder on/off signal 125 and the current scale signal 123 are logic low, no bleeder current $I_B$ 115 flows between first input terminal 109 and second input terminal 111. If the bleeder on/off signal 125 is logic high and the current scale signal 123 is logic low, a first value $I_{BL}$ of bleeder current $I_B$ 115 flows between first input terminal 109 and second input terminal 111. If both the bleeder on/off signal 125 and the current scale signal 123 are logic high, a second a second value $I_{BH}$ of bleeder current $I_B$ 115 flows between first input terminal 109 and second input terminal 111. The second value $I_{BH}$ of bleeder current $I_B$ 115 is greater than the first value $I_{BL}$ of bleeder current $I_B$ 115.

The input current sense circuit 120 is coupled to output the bleeder on/off signal 125 to the variable current circuit 122, in response to the input current $I_{IN}$ 119. The bleeder on/off signal 125 indicates if the input current $I_{IN}$ 119 has fallen to a value which is less than a threshold input current $I_{TH}$. If the input current $I_{IN}$ 119 is lower than $I_{TH}$, then the bleeder on/off signal is logic high; if the input current $I_{IN}$ 119 is greater than or equal to $I_{TH}$, then the bleeder on/off signal is logic low. When bleeder on/off signal 125 is logic high, the variable current circuit 122 is enabled, and when bleeder on/off signal 125 is logic low, the variable current circuit 122 is disabled.

The current scaling circuit 124 is coupled to receive a shutdown signal 128. In one example, if the conduction angle is less than a threshold conduction angle $A_{LTH}$, then shutdown signal 128 is logic high and if the conduction angle is equal to or greater than $A_{LTH}$, then the shutdown signal 128 is logic low. The value of $A_{LTH}$ may be predefined and may be measured in degrees. In one example, the $A_{LTH}$ is thirty degrees; however, the value of $A_{LTH}$ may be any value depending on the requirements of the lighting system.

In one example, if the shutdown signal 128 is logic low then the current scaling circuit 124 may be disabled, and if the shutdown signal 128 is logic high then the current scaling circuit 124 may be enabled. Furthermore, if the variable current circuit 122 is enabled but the current scaling circuit 124 is disabled, then the variable current circuit 122 may conduct a bleeder current of a lower value $I_{BL}$ because only the input current sense circuit 120 is enabled (in other words, the variable current circuit 122 is only receiving the bleeder on/off signal 125 and not both the bleeder on/off signal 125 and the current scale signal 123). If the variable current circuit 122 is enabled and the current scaling circuit 124 is also enabled, then the variable current circuit 122 may conduct a bleeder current of higher value $I_{BH}$. With either higher value $I_{BH}$ or lower value $I_{BL}$ of bleeder current $I_B$ 115, a sufficient holding current is drawn by input current $I_{IN}$ 119 to prevent a switch in dimmer circuit 102 from opening. This may help prevent unwanted flickering in an LED lamp driven by driver circuit 106, in accordance with the teachings of the present invention.

In one example, the shutdown signal 128 is an external signal. In other examples, the shutdown signal 128 is not an external signal and may result from a conduction angle detection circuit integrated with the variable bleeder circuit 104.

The variable bleeder circuit 104 also includes optional bleeder protection circuit 126 coupled to receive the shutdown signal 128 and the input voltage $V_{IN}$ 112. The bleeder protection circuit 126 is also coupled to output a bleeder bypass signal 127 to the current scaling circuit 124 in response to the shutdown signal 128 and the input voltage $V_{IN}$ 112. Under certain conditions, such as an open load condition (not shown), the shutdown signal may become erroneously logic high (falsely indicating that the conduction angle is low). In this situation, the bleeder protection circuit 126 can disable the current scaling circuit 124 by making the bleeder bypass signal 127 logic high. In other words, the bleeder protection circuit 126 can either enable or disable the current scaling circuit 124 in response to the shutdown signal 128 and the input voltage $V_{IN}$ 112. If the shutdown signal 128 is logic high and $V_{IN}$ 112 is greater than or equal to the bleeder protection voltage threshold $V_{BTH}$, then the bleeder bypass signal 127 is logic high. If the shutdown signal 128 is logic high but $V_{IN}$ 112 is lower than $V_{BTH}$ then the bleeder bypass signal 127 is logic low. The current scaling circuit 124 is enabled when the bleeder bypass signal 127 is logic high, and the current scaling circuit 124 is disabled when the bleeder bypass signal 127 is logic low. If the shutdown signal 128 is logic low, then the current scaling circuit 124 is disabled, and the variable current circuit 122 will conduct a bleeder current of lower value $I_{BL}$ (provided the input current sense circuit is enabled). Thus, the bleeder protection circuit 126 prevents the variable current circuit 122 from erroneously conducting a bleeder current of higher value $I_{BH}$.

Figure 2A:
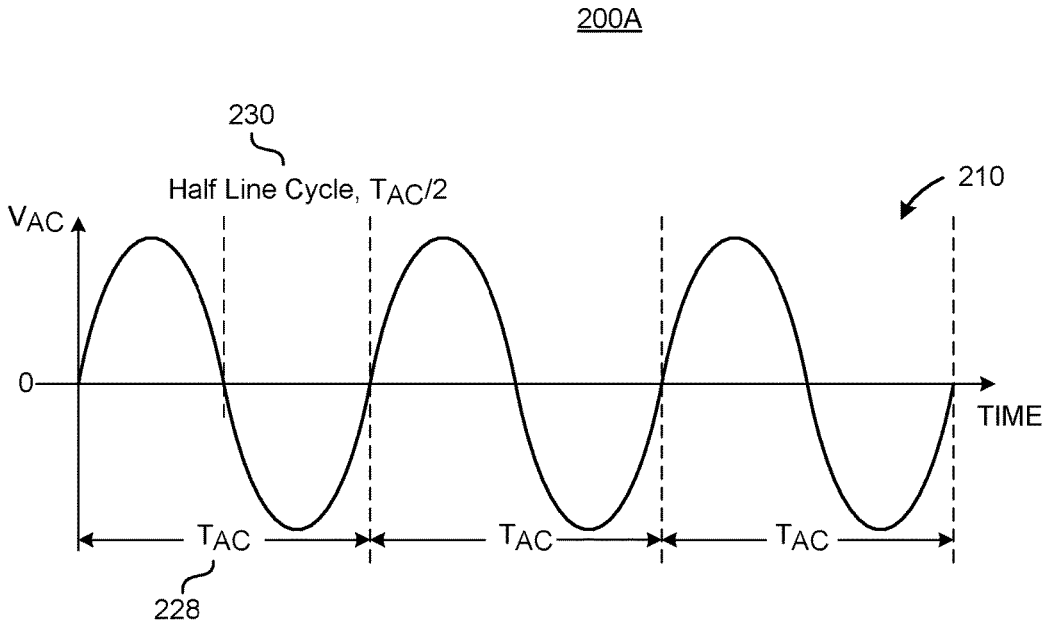
FIG. 2A illustrates an example of an ac input voltage waveform received by a driver circuit, in accordance with the teachings of the present invention.
Figure 2B:
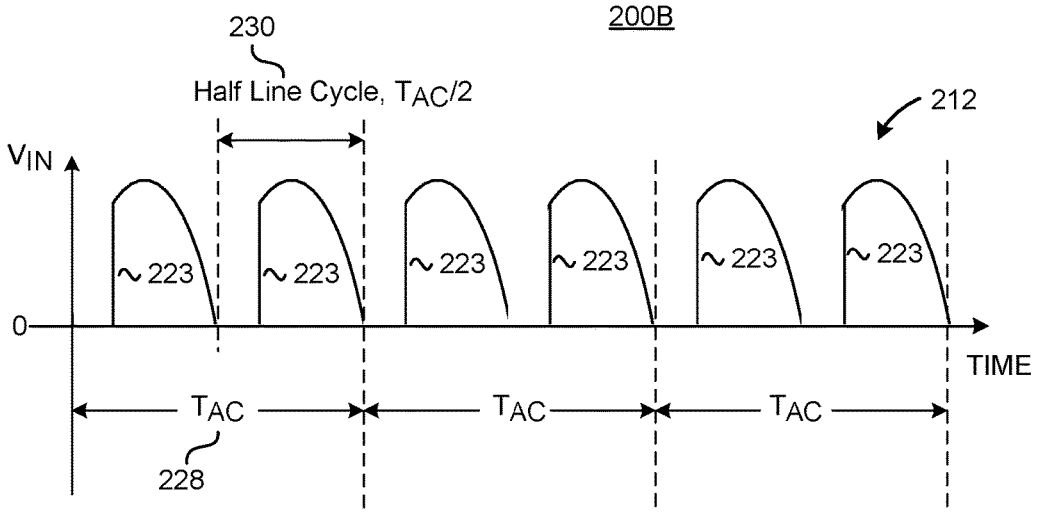
FIG. 2B illustrates an example input signal waveform received by a driver circuit through a dimmer circuit, in accordance with the teachings of the present invention.

FIG. 2A illustrates an example waveform 200A of an ac line voltage $V_{AC}$ 210 received by the dimmer circuit. FIG. 2B illustrates an example rectified waveform 200B of an input voltage $V_{IN}$ 212 received from a dimmer circuit (such as a TRIAC dimmer circuit) by a driver circuit of a lighting system. In the depicted example, ac line voltage $V_{AC}$ 210 is an ac input voltage (a sinusoidal waveform with a line cycle period $T_{AC}$ 228). The line cycle period $T_{AC}$ 228 of the ac line voltage $V_{AC}$ 210 may also be referred to as a full line cycle period. FIG. 2A also shows a half line cycle $T_{AC}/2$ 230, which is half of the line cycle period $T_{AC}$ 228. As shown, half line cycle $T_{AC}/2$ 230 is the length of time between consecutive zero crossings of ac line voltage $V_{AC}$ 210.

Referring briefly now back to FIG. 1, dimmer circuit 102 disconnects and reconnects the ac line voltage $V_{AC}$ 110 from the first input terminal 109 of driver circuit 106. In leading edge dimming, when the ac line voltage $V_{AC}$ 110 crosses the zero voltage, dimmer circuit 102 disconnects the ac line voltage $V_{AC}$ 110 from first input terminal 109. Thus, the ac line voltage $V_{AC}$ 110 is disconnected from the driver circuit 106 and variable bleeder circuit 104. After a given amount of time, dimmer circuit 102 reconnects ac line voltage $V_{AC}$ 110 to first input terminal 109 of driver circuit 106 and to variable bleeder circuit 104. However, one skilled in the art will appreciate that dimmer circuit 102 may also be a trailing edge dimmer. In trailing edge dimming, the dimmer circuit 102 connects the ac line voltage $V_{AC}$ 110 to the first input terminal 109 when the ac line voltage $V_{AC}$ 110 crosses zero voltage, and disconnects the ac line voltage $V_{AC}$ 110 after a given amount of time. Referring now to FIG. 1 and FIG. 2B, the dimmer circuit 102 removes a portion of each half line cycle $T_{AC}/2$ 230 of ac line voltage $V_{AC}$ 210 to limit the amount of voltage and current supplied by the driver circuit 106 to the load 108.

As shown in FIG. 2B, input voltage $V_{IN}$ 212 is substantially zero when the dimmer circuit 102 has disconnected the ac line voltage $V_{AC}$ 210 from first input terminal 109. Once the dimmer circuit 102 reconnects the ac line voltage $V_{AC}$ 210 to first input terminal 109, the voltage waveform of input voltage $V_{IN}$ 212 substantially follows the ac line voltage $V_{AC}$ 210. Edges 223 of input voltage $V_{IN}$ 212 result during each half line cycle $T_{AC}/2$ 230 from the high frequency transitions 223 caused by dimmer circuit 102 disconnecting and reconnecting ac line voltage $V_{AC}$ 210.

The amount of dimming corresponds to the length of time during which the dimmer circuit 102 disconnects the ac line voltage $V_{AC}$ 210 from first input terminal 109 of the input of driver circuit 106. It is noted that dimmer circuit 102 also includes an input (not shown), which provides dimmer circuit 102 with information regarding the amount of desired dimming.

Figure 3A:
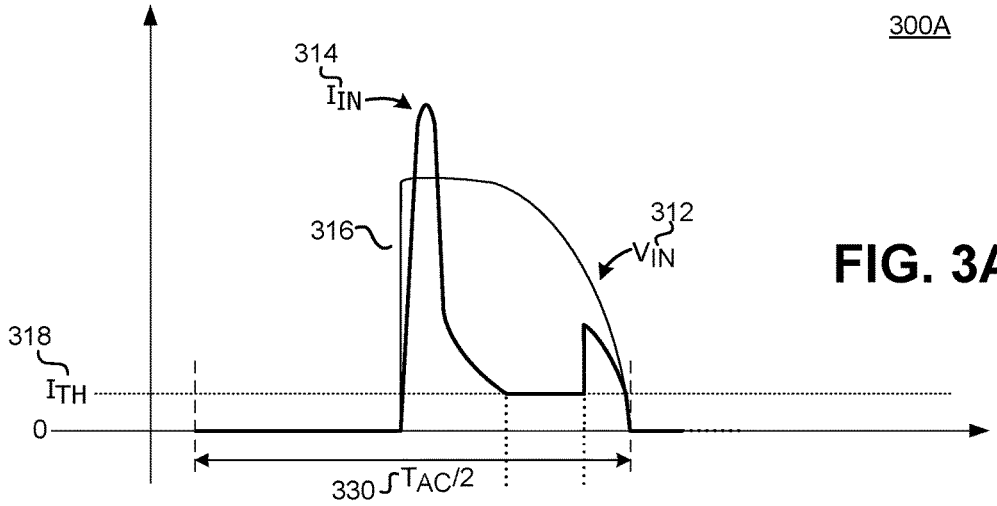
FIG. 3A illustrates example voltage and current waveforms of an input signal received by a driver circuit with an example variable bleeder current circuit, in accordance with the teachings of the present invention.
Figure 3B:
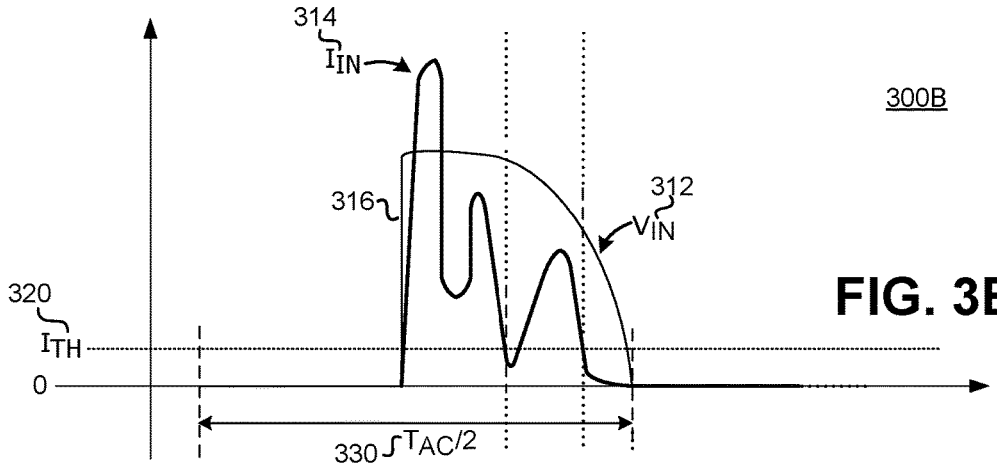
FIG. 3B illustrates example voltage and current waveforms of an input signal of a driver circuit without a bleeder circuit.

FIG. 3A illustrates timing diagram 300A. Timing diagram 300A shows example waveforms of input voltage $V_{IN}$ 312 and input current $I_{IN}$ 314 of a lighting system 100, which includes the variable bleeder circuit 104 (with optional bleeder protection circuit 126 and optional input current sense circuit 120, see e.g., the embodiment depicted in FIG. 4). Conversely, FIG. 3B illustrates timing diagram 300B showing example waveforms received by a driver circuit of a lighting system without a variable bleeder circuit. To help explain the advantages conferred by variable bleeder circuit 104, the description of FIG. 3A may be found immediately following the description of FIG. 3B.

In FIG. 3B, the input voltage $V_{IN}$ 312 is substantially zero at the beginning of the half line cycle $T_{AC}/2$ 330. When the dimmer circuit 102 reconnects the ac line voltage $V_{AC}$ 110, the input voltage $V_{IN}$ 312 increases quickly at high frequency transition (edge) 316, and substantially follows the voltage of ac line voltage $V_{AC}$ 110 for the remainder of the half line cycle 316. In some examples of leading edge dimming, at the beginning of the half line cycle $T_{AC}/2$ 330, the input current $I_{IN}$ 314 is also substantially zero until the dimmer circuit fires. Once the dimmer circuit 102 fires, the input current $I_{IN}$ 314 also increases quickly such that there is a high frequency transition (edge) of input current $I_{IN}$ 314. Without the inclusion of variable bleeder circuit 104, the input current $I_{IN}$ 314 rings (oscillates several times). This may be due in part to inductive and capacitive elements included in driver circuit 106. If the input current $I_{IN}$ 314 falls below the holding current of the dimmer circuit before the end of the half line cycle $T_{AC}/2$ 330, or before the input voltage $V_{IN}$ 312 has reached zero, the dimmer circuit may prematurely turn off and cause flickering in the load.

In FIG. 3A, examples in accordance with teachings of the present invention may reduce the ringing of the input current $I_{IN}$ 314. Similar to FIG. 3B, the input voltage $V_{IN}$ 312 in FIG. 3A is substantially zero until the dimmer circuit fires. Once the dimmer circuit fires, the input voltage $V_{IN}$ 312 increases rapidly (high frequency transition) and substantially follows the ac line voltage $V_{AC}$ 110. The input current $I_{IN}$ 314 is also substantially zero until the dimmer circuit 102 reconnects the ac line voltage $V_{AC}$ 110. Once the dimmer circuit 102 reconnects the ac line voltage $V_{AC}$ 110, the input current $I_{IN}$ 314 also increases quickly (high frequency transition). However, the inclusion of variable bleeder circuit 104 in FIG. 3A reduces ringing (current oscillations) and helps to prevent the input current $I_{IN}$ 314 from falling below $I_{TH}$ 318. Thus, input current $I_{IN}$ 314 is held above the holding current of dimmer circuit 102, in accordance with the teachings of the present invention.

Figure 3C:
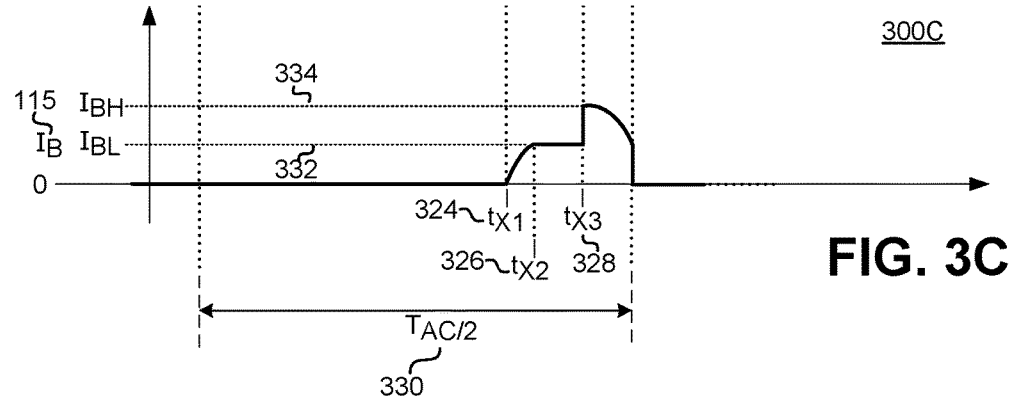
FIG. 3C illustrates example current waveforms of a variable bleeder circuit, in accordance with the teachings of the present invention.

FIG. 3C illustrates a timing diagram 300C depicting example waveforms of bleeder current $I_B$ 115 through a variable bleeder circuit 104 (including optional bleeder protection circuit 126 and optional input current sense circuit 120). Referring to both FIG. 3B and FIG. 3C, at time $t_{X1}$ 324, when the input current is lower than the holding current $I_{TH}$, the bleeder current $I_B$ 115 gradually starts increasing. At time $t_{X2}$ 326, the bleeder current $I_B$ 115 reaches a value $I_{BL}$ 332, the lower of two values of bleeder current $I_B$ 115. The bleeder current $I_B$ 115 remains substantially the same until time $t_{X3}$ 328. At time $t_{X3}$ 328, the shutdown signal may be logic high indicating that the conduction angle is below $A_{LTH}$. Therefore, the bleeder current $I_B$ 115 is increased to a value $I_{BH}$ 334, in accordance with the teachings of the present invention.

Figure 3D:
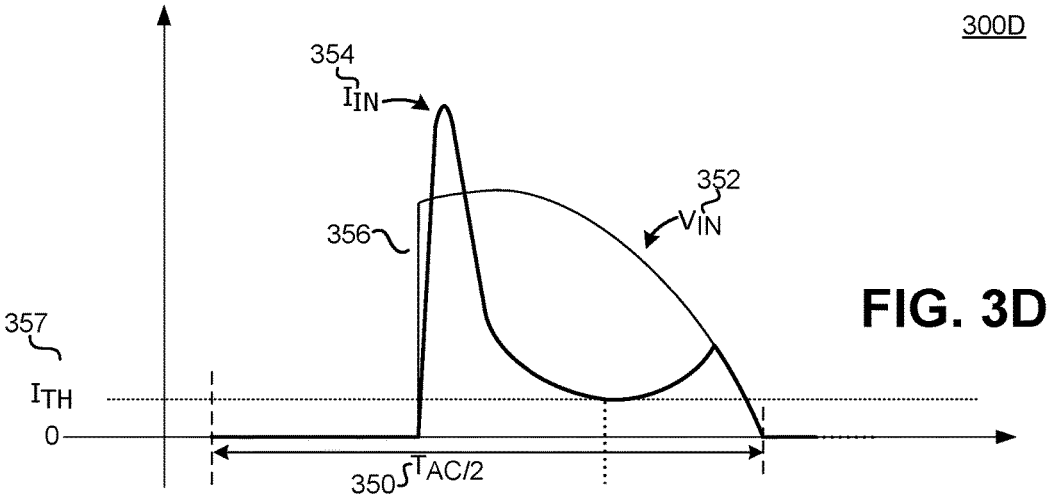
FIG. 3D illustrates example voltage and current waveforms of an input signal received by a driver circuit with an example bleeder circuit, in accordance with the teachings of the present invention.

FIG. 3D illustrates timing diagram 300D. Timing diagram 300D shows example waveforms of input voltage $V_{IN}$ 352 and input current $I_{IN}$ 354 of lighting system 100 including a variable bleeder circuit 104 (without optional bleeder protection circuit 126, and without optional input current sense circuit 120, see e.g., the embodiment depicted in FIG. 5). To help explain the advantages conferred by variable bleeder circuit 104, the description of FIG. 3D may be found immediately following the description of FIG. 3E.

Figure 3E:
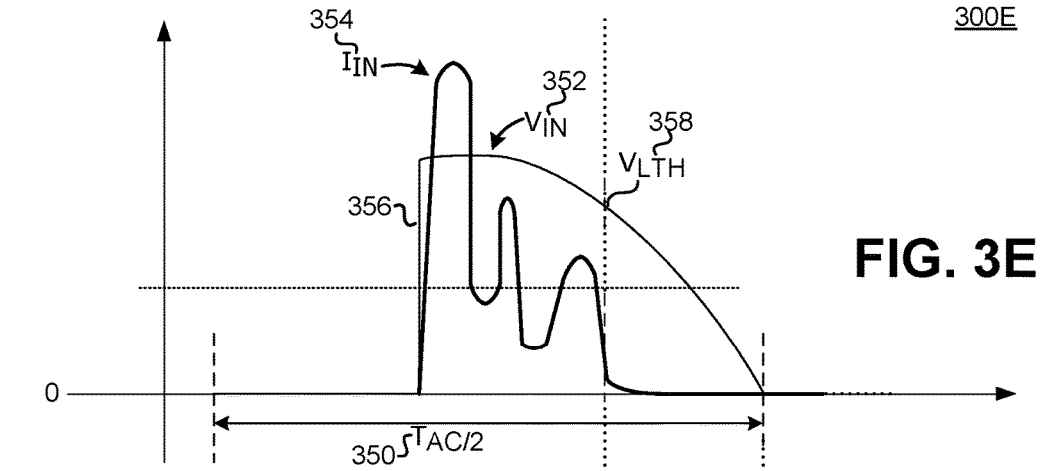
FIG. 3E illustrates example voltage and current waveforms of an input signal of a driver circuit without a bleeder circuit.

As illustrated in FIG. 3E, the input voltage $V_{IN}$ 352 is substantially zero at the beginning of the half line cycle $T_{AC}/2$ 350. When the dimmer circuit 102 reconnects the ac line voltage $V_{AC}$ 110, the input voltage $V_{IN}$ 352 increases quickly (high frequency transition 356) and substantially follows the voltage of ac line voltage $V_{AC}$ 110 for the remainder of the half line cycle $T_{AC}/2$ 350. At the beginning of the half line cycle $T_{AC}/2$ 350, the input current $I_{IN}$ 319 is also substantially zero until the dimmer circuit fires. Once the dimmer circuit 102 fires, the input current $I_{IN}$ 354 also increases. Without the inclusion of variable bleeder circuit 104, the input current $I_{IN}$ 354 may ring (oscillate several times). As explained earlier with respect to FIG. 3B, the ringing may be partially due to inductive and capacitive elements included within driver circuit 106. Further, if the input current $I_{IN}$ 354 falls below the holding current of the dimmer circuit before the end of the half line cycle $T_{AC}/2$ 350, or before the input voltage $V_{IN}$ 352 has reached zero, the dimmer circuit may prematurely turn off and cause flickering in the load driven by driver circuit.

However, as shown in FIG. 3D, the inclusion of variable bleeder circuit 104 may reduce ringing and help prevent the input current $I_{IN}$ 354 from falling below a threshold input current $I_{TH}$ 357 (which keeps the input current $I_{IN}$ 354 above the holding current of dimmer circuit 102), in accordance with teachings of the present invention. Furthermore, the input current $I_{IN}$ 354 may be scaled in response to the input voltage $V_{IN}$ 352 falling below a low input voltage threshold $V_{LTH}$ 358.

Figure 3F:
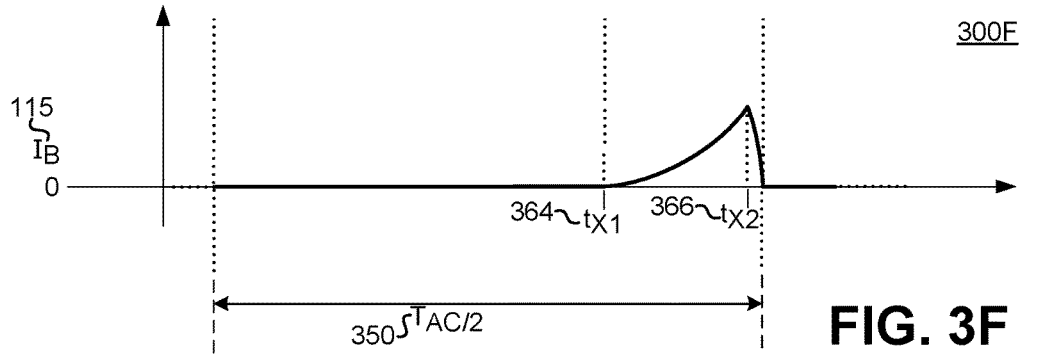
FIG. 3F illustrates example current waveforms of an example variable bleeder circuit, in accordance with the teachings of the present invention.

FIG. 3F illustrates timing diagram 300F. Timing diagram 300F shows example waveforms of bleeder current $I_B$ 115 of the variable bleeder circuit 104 (without optional bleeder protection circuit 126, and without optional input current sense circuit 120, see e.g. FIG. 5). Referring to both FIG. 3E and FIG. 3F, at time $t_{X1}$ 364, when the input voltage $V_{IN}$ 352 is lower than $V_{LTH}$ 358, the bleeder current $I_B$ 115 gradually starts increasing. At time $t_{X2}$ 366, the bleeder current may reach a maximum value. After time $t_{X2}$ 366, the bleeder current $I_B$ 115, may substantially follow the input voltage $V_{IN}$ 352 for the remaining portion of the half line cycle.

Figure 4:
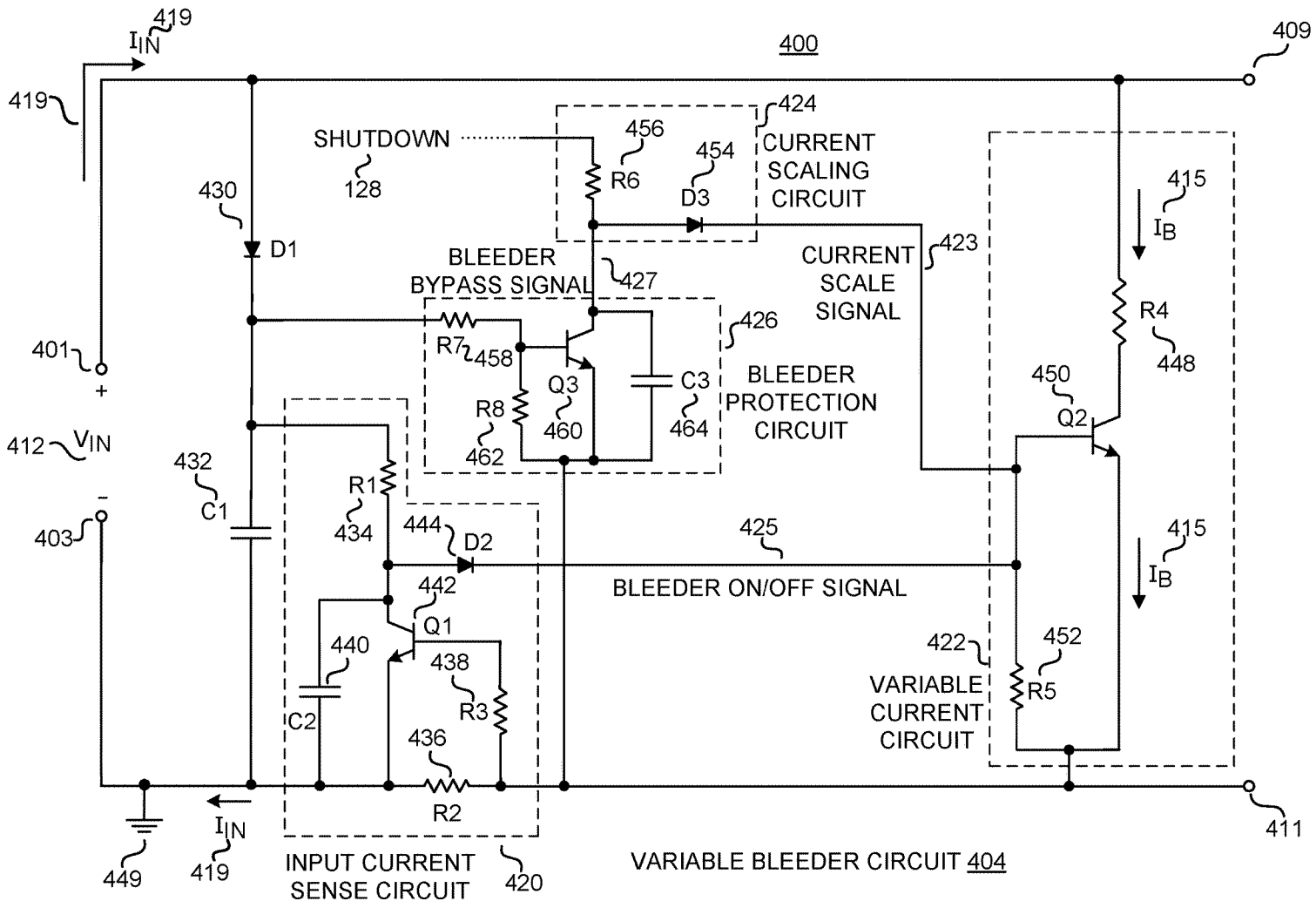
FIG. 4 is a schematic of an example variable bleeder circuit included in the driver circuit of FIG. 1, in accordance with the teachings of the present invention.

FIG. 4 is a schematic 400 illustrating a variable bleeder circuit 404 which is an example of the variable bleeder circuit 104 included in the lighting system 100 of FIG. 1, in accordance with the teachings of the present invention. The variable bleeder circuit 404 depicts an embodiment of the disclosure that includes optional pieces of circuitry (i.e., bleeder protection circuit 426, and input current sense circuit 420), along with pieces of circuitry common to other embodiments (i.e., current scaling circuit 424, and variable current circuit 422).

The input current sense circuit 420 is included in variable bleeder circuit 404 and is coupled to one of first and second input terminals 409 and 411 respectively of the driver circuit (not shown). The input current sense circuit 420 is coupled to output a bleeder on/off signal 425 in response to the input current $I_{IN}$ 419. The variable current circuit 422 is coupled between first input terminal 409 and second input terminal 411 of driver circuit 406 and conducts a bleeder current $I_B$ 415 between the first input terminal 409 and the second input terminal 411 in response to the bleeder on/off signal 425. Additionally, the variable current circuit 422 is coupled to conduct either a higher value $I_{BH}$ or a lower value $I_{BL}$ of the bleeder current $I_B$ 415, in response to a current scale signal 423. With bleeder current $I_B$ 415 flowing between first input terminal 409 and the second input terminal 411, the input current $I_{IN}$ 419 is greater than or equal to the holding current of the dimmer. Keeping the input current $I_{IN}$ 419 above the holding current may prevent a switch in dimmer circuit 402 from turning off prematurely, and reduce unwanted flickering in LED lamps.

In the illustrated example, input current sense circuit 420 includes a current sense transistor Q1 442 (hereafter Q1 442), a current sense resistor R2 436 (hereafter R2 436), a resistor R1 434, a resistor R3 438, a capacitor C2 440, and a diode D2 444. The R2 436 is coupled to sense the input current $I_{IN}$ 419. The first input terminal 411 and control terminal of Q1 442 are coupled to the R2 436, hereafter R2 436. In one example, R2 436 is coupled to the control terminal of Q1 442 through the resistor R3 438. An anode of the diode D2 444 is coupled to a first terminal of Q1 442. The cathode of the diode D2 444 is coupled to produce the bleeder on/off signal 425. The capacitor C1 432, diode D1 430, and the resistor R1 434, are also coupled to the output of diode D2 444 and the Q1 442.

In the illustrated example, Q1 442 is an NPN bipolar transistor, with the R2 436 coupled between the base and emitter. The base to emitter voltage of the Q1 442 may be referred to as $V_{SENSE}$ (not shown), and the current through R2 436 may be referred to as $I_{SENSE}$ (not shown). The value of $I_{SENSE}$ may be substantially given by—

$$I_{SENSE} = \frac{V_{SENSE}}{R2}$$

The values of resistors R2 436 and R3 438 are selected so when the input current $T_{IN}$ 419 is greater than or equal to $I_{TH}$, $I_{SENSE}$ produces enough voltage across resistor R2 436 (and at the control terminal of the Q1 442), to fully turn on or keep the Q1 442 in saturation. In other words, the control terminal of the Q1 442 is logic high. When the Q1 442 is in saturation, the anode of diode D2 444 is pulled low and the diode D2 444 is reverse biased. Accordingly, the bleeder on/off signal 425 is logic low and the variable current circuit 422 is disabled.

When the input current $I_{IN}$ 419 is less than $I_{TH}$, the $I_{SENSE}$ does not produce enough voltage across R2 436 to turn on the Q1 442. In other words, the control terminal of the Q1 442 is logic low and the transistor Q1 442 is turned off. Accordingly, the anode of output diode D2 444 is high and forward biased, making the bleeder on/off signal logic high. When diode D2 444 is not conducting, the input current sense circuit 420 turns the bleeder on/off signal 425 logic low and disables the variable current circuit 422. When diode D2 444 is conducting, the input current sense circuit 420 turns the bleeder on/off signal 425 logic high and enables the variable current circuit 422. Further, diode D2 444 may be used to ensure that current flows in one direction (from the input current sense circuit 420 to the variable current circuit 422).

Variable current circuit 422 includes a transistor Q2 450, a resistor R4 448, and a resistor R5 452. The variable current circuit 422 is coupled to conduct the bleeder current $I_B$ 415 between input terminals 409 and 411 of the driver circuit (not shown), in response to the bleeder on/off signal 425 and the current scale signal 423. One end of the resistor R4 452 is coupled to the first input terminal 409 of driver circuit 406. The other end of resistor R4 452 is coupled to a first terminal of the transistor Q2 450. A second terminal of the transistor Q2 450 is coupled to the second input terminal 411 of driver circuit 406, and a control terminal of the transistor Q2 450 is coupled to receive the bleeder on/off signal 425. One end of the resistor R5 452 is coupled to the control terminal of the transistor Q2 450, and the other end of resistor R5 452 is coupled to the second input terminal 411.

If the bleeder on/off signal 425 is logic low, then the transistor Q2 450 is off and the value of bleeder current $I_B$ 415 is substantially zero. If the bleeder on/off signal 425 is logic high, then the transistor Q2 450 is on and conducts bleeder current $I_B$ 415. As will be explained later, when the bleeder on/off signal 425 is logic high, the transistor Q2 450 may operate either in a linear regime or a saturation regime (in response to the current scale signal 423).

Transistor Q2 450 may be a NPN bipolar transistor, or a PNP bipolar transistor. However, one skilled in the art will appreciate that other transistors may be used, such as metal-oxide-semiconductor field-effect transistors (MOSFETs), junction gate field-effect transistors (JFETs), or insulated gate bipolar transistors (IGBTs). The bleeder current $I_B$ 415 may be substantially equal to the current provided by bleeder on/off signal 425 multiplied by the beta of transistor Q2 450.

The current scaling circuit 424 is coupled to receive the shutdown signal 128. The output of the current scaling circuit 424 is coupled to the control terminal of transistor Q2 450 as the current scale signal 423. The current scaling circuit 424 includes a current scale resistor R6 456 and a diode D3 454. In one example, the current scaling circuit 424 is coupled to vary the bleeder current $I_B$ 415 through the variable current circuit 422 in response to the shutdown signal 128 and the bleeder bypass signal 427. One end of the current scale resistor R6 456 is coupled to receive the shutdown signal 128 and the other end of current scale resistor R6 456 is coupled to the anode of the diode D3 454. The cathode of diode D3 454 is coupled to the control terminal of the transistor Q2 450.

The transistor Q2 450 is controlled by both bleeder on/off signal 425 via the input current sense circuit 420 and current scale signal 423 via the current scaling circuit 424. If the shutdown signal 128 is logic low, then the voltage across the resistor R6 456 is not high enough to forward bias the diode D3 454. Subsequently, the current scale signal 423 is logic low. If the shutdown signal 128 is logic high, then the voltage across the resistor R6 456 is large enough to forward bias the diode, and the current scale signal 423 becomes logic high. Accordingly, the Q2 450 is fully turned and operates in the saturation regime. If the bleeder on/off signal 425 is logic high but if the shutdown signal 128 is logic low, then the transistor Q2 450 is partially turned on and operates in the linear regime. Thus, the transistor Q2 450 conducts a bleeder current of a lower value $I_{BL}$. If the bleeder on/off signal 425 is logic high and the shutdown signal 128 is also logic high, transistor Q2 450 is fully turned on and operates in the saturation regime. Thus, the transistor Q2 450 conducts a bleeder current of a higher value $I_{BH}$. The transistor Q2 450 is substantially controlled by the current scaling circuit 424 when the shutdown signal 128 is high. In summary, if the conduction angle is equal to or greater than $A_{LTH}$, then the transistor Q2 450 is only partially turned on and may conduct a bleeder current of a lower value $I_{BL}$; if the conduction angle is lower than $A_{LTH}$, then the transistor Q2 450 is fully turned on and conducts a bleeder current of higher value $I_{BH}$.

The variable bleeder circuit 404 may also include an optional bleeder protection circuit 426. The example bleeder protection circuit 426 includes a transistor Q3 460, an input voltage sense resistor R7 458, a resistor R8 466, and a capacitor C3 464. The bleeder protection circuit 426 is coupled to sense the input voltage $V_{IN}$ 112 and the shutdown signal 128. The bleeder protection circuit 426 is coupled to output bleeder bypass signal 427 to the current scaling circuit 424.

A first terminal of transistor Q3 460 is coupled to receive the shutdown signal 128. A second terminal of transistor Q3 460 is coupled to input terminal 411 of the driver circuit. A control terminal of transistor Q3 460 is coupled to sense the input voltage $V_{IN}$ 412 via resistor R7 458. The values of resistors R7 458 and R8 462 are chosen such that the turn-on voltage of the transistor Q3 460 is substantially equal to the $V_{BTH}$. In operation, if the shutdown signal 128 is logic high (indicating that the conduction angle is lower than $A_{LTH}$), and if the input voltage $V_{IN}$ 412 is lower than $V_{BTH}$, then the control terminal of the transistor Q3 460 is low and the transistor Q3 460 is turned off. Accordingly, the anode of diode D3 454 is high, and diode D3 454 is forward biased, making the current scale signal logic high. Subsequently, variable current circuit 422 conducts bleeder current of higher value $I_{BH}$. Conversely, if the shutdown signal 128 is logic high and the input voltage $V_{IN}$ 412 is greater than or equal to $V_{BTH}$ then the control terminal of transistor Q3 460 becomes high, and the transistor Q3 460 is fully turned on (operating in saturation). This further makes the anode of diode D3 454 logic low, reverse biasing the diode D3 454. When the diode D3 454 is reverse biased, the transistor Q2 450 changes from saturation operation to linear operation. Subsequently, the bleeder current through the variable current circuit 422 is decreased from a higher value to $I_{BH}$ to a lower value $I_{BL}$. Thus, the bleeder protection circuit 426 may protect the variable bleeder circuit from conducting higher value of bleeder current in case of an open load condition. The capacitor C3 464 is a bypass capacitor.

Figure 5:
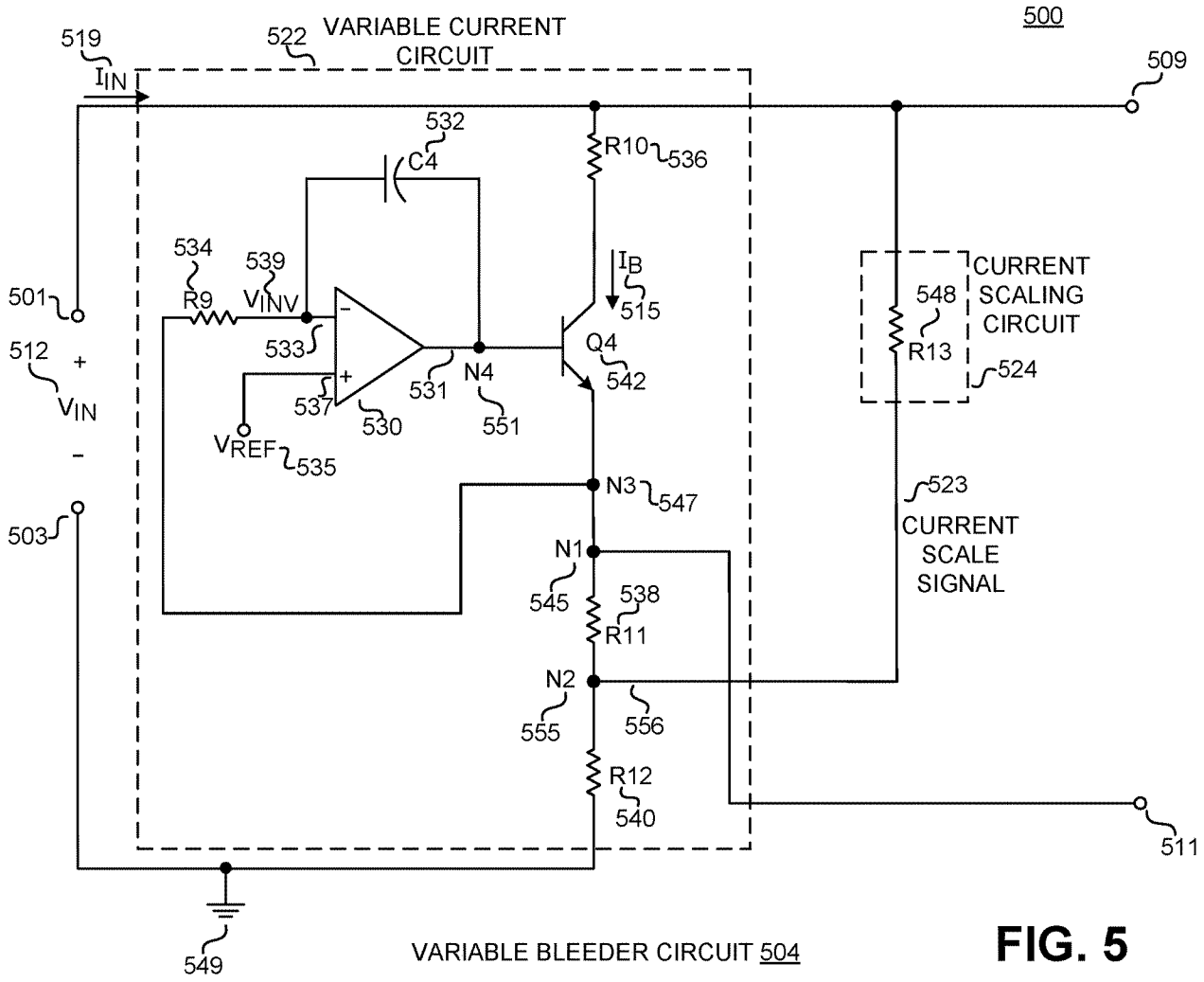
FIG. 5 is a schematic of an example variable bleeder circuit included in the driver circuit of FIG. 1, in accordance with the teachings of the present invention.

FIG. 5 is a schematic 500 illustrating a variable bleeder circuit 504 which is an example of the variable bleeder circuit 104 included in the lighting system 100 of FIG. 1, in accordance with the teachings of the present invention. The example variable bleeder circuit 504 depicts an embodiment without optional bleeder protection circuit 126 and without optional input current sense circuit 120.

The variable bleeder circuit 504 is coupled to receive an input voltage $V_{IN}$ 512 from a rectifier (not shown) at the terminals 501 and 503. The input voltage $V_{IN}$ 512 is positive with respect to the input return 549. The variable bleeder circuit 504 is coupled to receive an input current $I_{IN}$ 519 in the direction shown. The variable bleeder circuit 504 may be coupled to a driver circuit (not shown) via a first input terminal 509 and a second input terminal 511.

In the depicted example, the variable bleeder circuit 504 includes a variable current circuit 522 and a current scaling circuit 524. The variable bleeder circuit 504 may be implemented as a monolithic integrated circuit, with discrete electrical components, or a combination of discrete and integrated components. The variable current circuit 522 is coupled to conduct a bleeder current $I_B$ 515 between the first input terminal 509 and the second input terminal 511 of the driver circuit 506 in response to the input voltage $V_{IN}$ 512, in accordance with the teachings of the present invention.

The variable current circuit 522 includes a transistor Q4 542, a resistor R10 536, a resistor R11 538, a resistor R12 540, an op-amp 530, a capacitor C4 532, and a resistor R9 534. One end of the resistor R10 536, is coupled to a first terminal of the transistor Q4 542. A second terminal of transistor Q4 542 is coupled to one end of the resistor R11 538 at a first node N1 545. A control terminal of transistor Q4 542 is coupled to an output 531 of an op-amp 530. The other end of the resistor R11 538 is coupled to one end of the resistor R12 540 at a second node N2 555. A second end of the resistor R12 540 is coupled to the second input terminal 511 of the driver circuit (not shown). The op-amp 530 is coupled as an error amplifier. The non-inverting input 537 of op-amp 530 is coupled to receive a reference voltage $V_{REF}$ 535. A capacitor C4 532 is coupled in the feedback path of the op-amp 530 in such a way that one end of the capacitor C4 532 is coupled to the inverting terminal 533 of the op-amp 530, and the other end of the capacitor C4 532 is coupled to the output 531 of the op-amp 530. One end of resistor R9 534 is coupled to the inverting terminal of the op-amp 530, and the other end of resistor R9 534 is coupled to the second terminal of transistor Q4 542 at a third node N3 547.

In the illustrated example, the current scaling circuit 524 includes a current scaling circuit resistor R13 548. One end of the resistor R13 548 is coupled to receive the input voltage $V_{IN}$ 512 via the first input terminal 509. The other end of the resistor R13 548 is coupled to resistor R12 540 at a second node N2 555. The current scaling circuit 524 is coupled to output a current scale signal 523 at the second node N2 555. In one example, the current scale signal 555 is a voltage signal. The current scale resistor R13 548 forms a potential divider circuit with the resistor R12 540.

The voltage $V_{N2}$ at the node N2 555 may be given by—

$$V_{N2} = V_{IN}\frac{R12}{R12 + R13} \tag{1}$$

The reference voltage $V_{REF}$ 535 may be chosen by design. Because of the op-amp action, the voltage $V_{INV}$ 539 at the inverting terminal is maintained substantially equal to $V_{REF}$ 535. If $V_{R9}$ is assumed to be the voltage across the resistor R9 534, and if $I_{R9}$ is assumed to be the current through the resistor R9 534, then voltage $V_{N1}$ at node N1 545 may be given by—

$$V_{N1} = V_{REF} - V_{R9} \tag{2}$$

$$V_{R9} = I_{R9}R9 \tag{3}$$

If $V_{N4}$ is assumed to be the voltage at the node N4 551 and $X_{C4}$ is assumed to be the capacitive reactance of the capacitor C4 532, then the current through resistor R9 may be substantially given by equation—

$$V_{R9} = \frac{V_{N3} - V_{REF}}{X_{C4}} \tag{4}$$

From equations 2, 3, and 4 above, it may be understood that the voltage $V_{N1}$ at node N1 545 may also be substantially constant and independent of the input voltage $V_{IN}$ 512.

However, as the input voltage $V_{IN}$ 512 varies then, the voltage across the resistors R12 540 and R13 548 also varies; this may cause the voltage $V_{N2}$ at the node N2 555 to change (as shown by equation 1). Since $V_{N1}$ is substantially constant, one end of resistor R11 538 is maintained at a constant voltage while the voltage at the other end of resistor R11 538 may vary. It may be appreciated that this varying voltage across the resistor R11 538 may draw more current through the transistor Q4 542. Accordingly, if the input voltage $V_{IN}$ 512 increases then the bleeder current $I_B$ 115 will decrease, and if the input voltage $V_{IN}$ 512 decreases, then the bleeder current $I_B$ 115 will increase. In other examples, other circuitry such as peak detectors, comparators, logic gates may be included as part of the variable bleeder circuit. In some examples, the bleeder current may be increased as the input voltage increases and the bleeder current may be decreased as the input voltage decreases.

Transistor Q4 542 may be an NPN bipolar transistor or a PNP bipolar transistor. However, one of ordinary skill in the art will appreciate that other transistors may be used, such as metal-oxide-semiconductor field-effect transistors (MOSFETs), junction gate field-effect transistors (JFETs), or insulated gate bipolar transistors (IGBTs).

Figure 6:
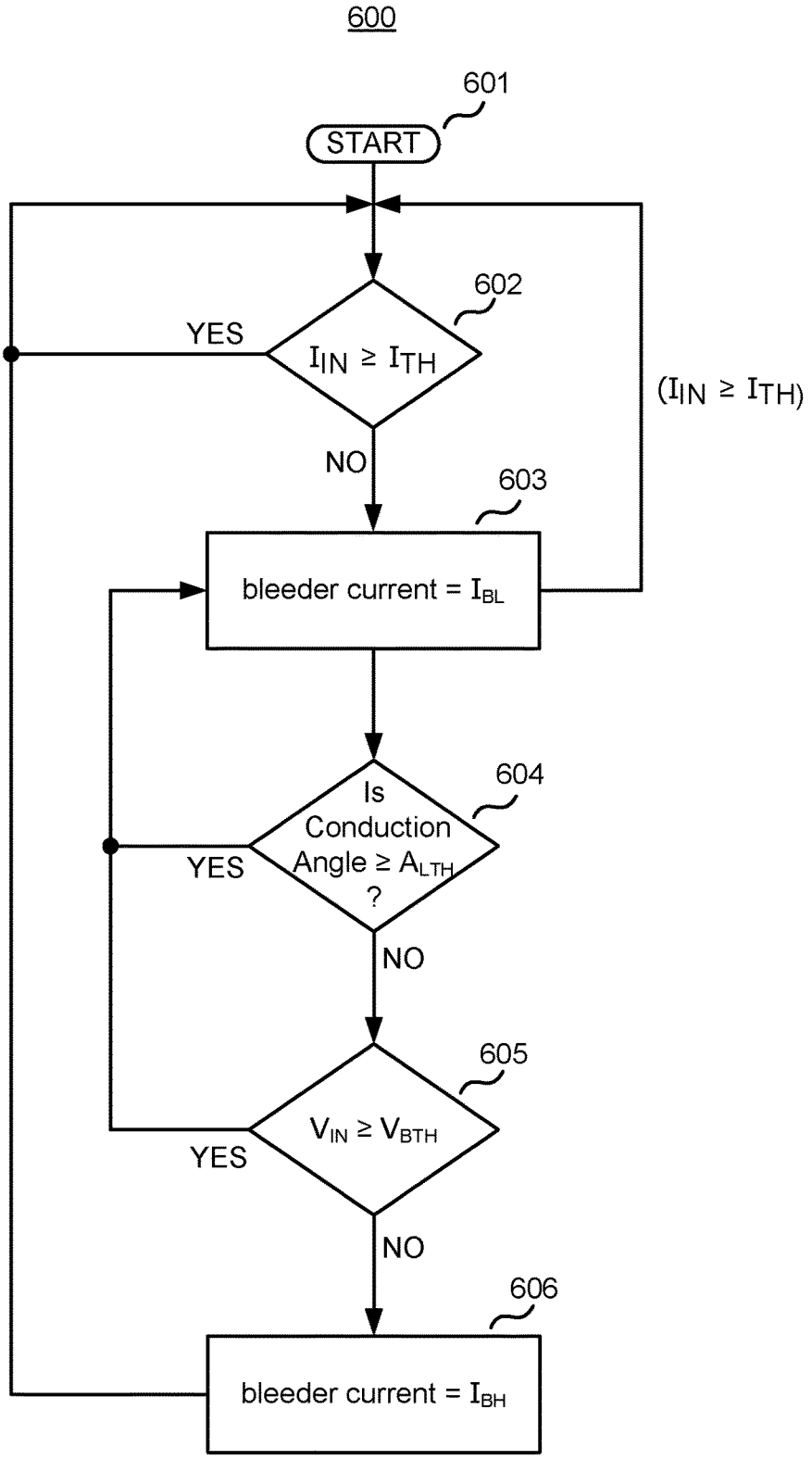
FIG. 6 is a flow chart 600 illustrating an example process for scaling the bleeder current, in accordance with the teachings of the present invention.

FIG. 6 is a flow chart 600 illustrating an example process for scaling the bleeder current in response to sensing a low input current and/or a low conduction angle, consistent with an embodiment of a variable bleeder circuit including optional pieces of circuitry bleeder protection circuit 426, and input current sense circuit 420 (see e.g., FIG. 4).

After starting at block 601, block 602 illustrates checking if the input current $I_{IN}$ is greater than $I_{TH}$. If the input current $I_{IN}$ is equal to greater than $I_{TH}$, the process proceeds to the beginning of block 602. If the input current $I_{IN}$ is less than $I_{TH}$, the process proceeds to the block 603.

At block 603 the bleeder current is maintained at a lower value $I_{BL}$. The process then checks if $I_{IN}$ is equal to or greater than $I_{TH}$. If $I_{IN}$ is equal to or greater than $I_{TH}$, the process will go back to the beginning of block 602, otherwise the process will proceed to block 604.

Block 604 illustrates checking if the conduction angle is greater than or equal to a threshold conduction angle $A_{LTH}$. If the conduction angle is equal to or greater than $A_{LTH}$, then the process proceeds to block 603. If the conduction angle is less than $A_{LTH}$, then the process proceeds to block 605.

At block 605 if the input voltage is equal to or greater than a bleeder protection voltage threshold voltage $V_{BTH}$, the process proceeds to block 603. If the input voltage is less than the bleeder protection voltage threshold voltage $V_{BTH}$, the process proceeds to block 606.

At block 606 the bleeder current is maintained at a higher bleeder current value $I_{BH}$. At the end of block 606, the process goes back to block 601.

Figure 7:
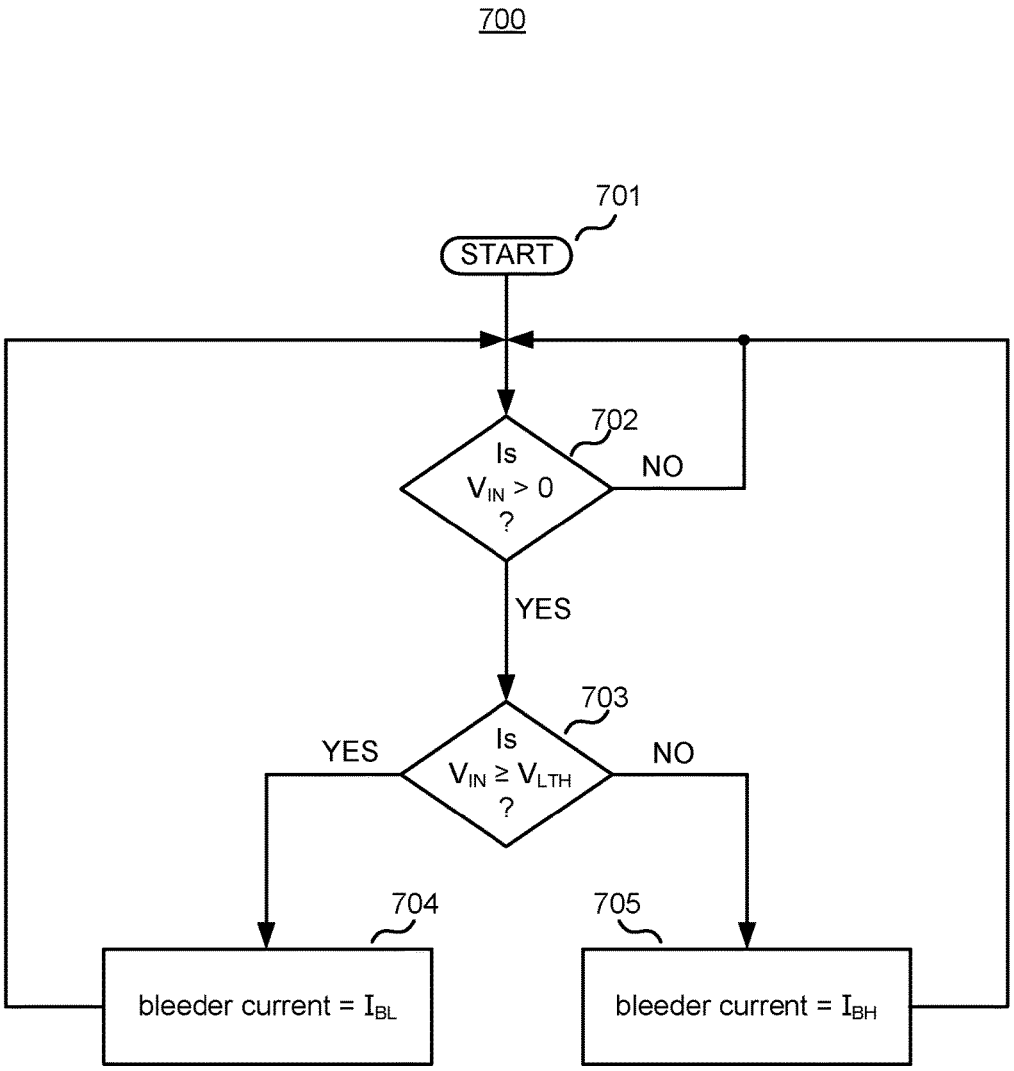
FIG. 7 is a flow chart 700 illustrating an example process for scaling the bleeder current, in accordance with the teachings of the present invention.

FIG. 7 is a flow chart 700 illustrating an example process for scaling the bleeder current in response to sensing a low input voltage, constant with an embodiment of the disclosure where the variable bleeder circuit does not include optional bleeder protection circuit 126, and does not include optional input current sense circuit 120 (see e.g., FIG. 5).

Starting at block 701, block 702 illustrates checking if the input voltage $V_{IN}$ is greater than or equal to zero. If the input voltage $V_{IN}$ is greater than zero, then the process proceeds to block 703.

Block 703 illustrates checking if the input voltage is greater than or equal to $V_{LTH}$. If the input voltage is greater than or equal to $V_{LTH}$, then the process proceeds to block 704. If the input voltage is lower than $V_{LTH}$, then the process proceeds to block 705.

At block 704 the bleeder current may be maintained at a lower value $I_{BL}$. At the end of block 704, the process goes back to block 701.

At block 705 the bleeder current may be maintained at a higher value $I_{BH}$. At the end of block 705, the process goes back to block 701.

The above description of illustrated examples of the present invention, including what is described in the Abstract, are not intended to be exhaustive or to limit the invention to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

What is claimed is:

1. A bleeder circuit, comprising:

an input current sense circuit coupled to one of first and second input terminals of a driver circuit to output a bleeder on/off signal in response to an input current through the first and second input terminals of the driver circuit, wherein the driver circuit is coupled to drive a load;

a variable current circuit coupled between the first and second input terminals of the driver circuit and coupled to the input current sense circuit, wherein the variable current circuit is coupled to conduct a bleeder current between the first and second input terminals in response to the bleeder on/off signal; and a current scaling circuit coupled to the variable current circuit, wherein the current scaling circuit is coupled to output a current scale signal coupled to be received by the variable current circuit in response to a shutdown signal, wherein the shutdown signal is representative of a conduction angle.

2. The bleeder circuit of claim 1, wherein the variable current circuit is coupled to increase the bleeder current to a first value in response to the bleeder on/off signal indicating that the input current is less than a threshold current.

3. The bleeder circuit of claim 2, wherein the threshold current is greater than or equal to a holding current of a dimmer circuit coupled to at least one of the first and second input terminals.

4. The bleeder circuit of claim 2, wherein the variable current circuit is coupled to the current scaling circuit to increase the bleeder current to a second value in response to the current scale signal indicating a conduction angle is less than a threshold conduction angle.

5. The bleeder circuit of claim 4, wherein the first value is less than the second value.

6. The bleeder circuit of claim 4, wherein the input current sense circuit turns the bleeder on/off signal logic high if the input current is lower than the threshold current, and turns the bleeder on/off signal logic low if the input current is equal to or greater than the threshold current.

7. The bleeder circuit of claim 1, wherein the input current sense circuit includes a current sense resistor coupled to said one of the first and second input terminals of the driver circuit, wherein a voltage drop across the current sense resistor is responsive to the input current.

8. The bleeder circuit of claim 7, wherein the input current sense circuit includes a current sense transistor coupled to the current sense resistor, wherein the current sense transistor is coupled to turn on in response to the voltage drop across the current sense resistor.

9. The bleeder circuit of claim 8, wherein the current sense resistor is coupled to a control terminal of the current sense transistor, and coupled to said one of the first and second input terminals of the driver circuit.

10. The bleeder circuit of claim 1, wherein the current scaling circuit includes a current scale resistor coupled to a diode, wherein the current scale resistor is coupled to receive the shutdown signal, and wherein the diode is coupled to output the current scale signal in response to a voltage drop across the current scale resistor.

11. The bleeder circuit of claim 1, wherein the variable current circuit comprises a first transistor having a first terminal coupled to said one of the first and second input terminals of the driver circuit, and a second terminal coupled to another one of the first and second input terminals of the driver circuit, wherein a control terminal of the first transistor is coupled to receive the bleeder on/off signal, and further coupled to receive the current scale signal.

12. The bleeder circuit of claim 1, wherein the input current is conducted through the first and second input terminals of the driver circuit from a dimmer circuit.

13. The bleeder circuit of claim 1, wherein the shutdown signal is representative of a conduction angle which is representative of a portion of an ac line voltage.

14. The bleeder circuit of claim 1, wherein the shutdown signal is logic high if a conduction angle is lower than a first threshold, and the shutdown signal is logic low if the conduction angle is greater than or equal to the first threshold.

15. The bleeder circuit of claim 14, wherein the current scaling circuit is enabled if the shutdown signal is logic high, and the current scaling circuit is disabled if the shutdown signal is logic low.

16. The bleeder circuit of claim 15, further comprising a bleeder protection circuit, coupled between the first and second input terminals of the driver circuit to receive an input voltage, wherein the bleeder protection circuit comprises a second transistor coupled to output a bleeder bypass signal to the current scaling circuit.

17. The bleeder circuit of claim 16, wherein the current scaling circuit is coupled to output a logic low current scale signal when the bleeder bypass signal is logic high, and coupled to output a logic high current scale signal when the bleeder bypass signal is logic low.

18. The bleeder protection circuit of claim 16, wherein the bleeder bypass signal is logic high if the input voltage is equal to or greater than a threshold voltage, and the bleeder bypass signal is logic low if the input voltage is lower than the threshold voltage.

19. A circuit for use in a lighting system, comprising:

a driver circuit having first and second input terminals coupled to conduct an input current, wherein the driver circuit is coupled to drive a load; and a bleeder circuit, coupled between the first and second input terminals of the driver circuit, the bleeder circuit including:

an input current sense circuit coupled to output a bleeder on/off signal in response to the input current;

a current scaling circuit coupled to output a current scale signal in response to a shutdown signal, the shutdown signal being representative of a conduction angle; and a variable current circuit coupled to the input current sense circuit to conduct a bleeder current between the first and second input terminals in response to bleeder on/off signal, wherein the variable current circuit is further coupled to the current scale circuit to conduct the bleeder current between the first and second input terminals in response to the current scale signal.

20. The circuit of claim 19, further comprising a rectifier coupled to the first and second input terminals of the driver circuit.

21. The circuit of claim 19, wherein the variable current circuit is coupled to increase the bleeder current to a first value in response to the bleeder on/off signal indicating that the input current is less than a threshold current, and wherein the variable current circuit is coupled to increase the bleeder current to a second value in response to the in response to the current scale signal indicating that the conduction angle is less than a first threshold.

22. The circuit of claim 21, wherein the threshold current is greater than or equal to holding current of a thyristor circuit coupled to at least one of the first and second input terminals of the driver circuit.

23. The circuit of claim 19, wherein the input current sense circuit comprises a current sense resistor coupled to one of the first and second input terminals of the driver circuit, wherein a voltage drop across the current sense resistor is responsive to the input current, and wherein the input current sense circuit further comprises a current sense transistor coupled to the current sense resistor, wherein the current sense transistor is coupled to be turned on in response to the voltage drop across the current sense resistor.

24. The circuit of claim 19, wherein the current scaling circuit comprises a current scale resistor coupled to a diode, wherein the diode is coupled to output the current scale signal in response to a voltage drop across the current scale resistor.

25. A bleeder circuit, comprising:

a variable current circuit, coupled between first and second input terminals of a driver circuit to conduct a bleeder current between the first and second input terminals of the driver circuit in response to a bleeder on/off signal, wherein the variable current circuit is coupled to increase the bleeder current as an input voltage decreases, and coupled to decrease the bleeder current as the input voltage increases; and a current scaling circuit coupled to the variable current circuit to output a current scale signal in response to the input voltage, wherein the variable current circuit includes a first transistor having a first terminal coupled to one of the first and second input terminals of the driver circuit, and a second terminal coupled to another one of the first and second input terminals of the driver circuit to receive the current scale signal, wherein a control terminal of the first transistor is coupled to an output terminal of an operational amplifier, and wherein the operational amplifier has an inverting input terminal coupled to receive the input voltage, and a non-inverting input terminal coupled to receive a reference voltage.

26. A circuit for use in a lighting system, comprising:

a driver circuit, having first and second input terminals coupled to receive an input voltage to drive a load coupled to an output of the driver circuit;

a variable current circuit coupled between the first and second input terminals of the driver circuit to conduct a bleeder current between the first and second input terminals in response to a bleeder on/off signal; and a current scaling circuit coupled to the variable current circuit to output a current scale signal to the variable current circuit in response to the input voltage, wherein the variable current circuit is further coupled to conduct the bleeder current between the first and second input terminals of the driver circuit in response to the current scale signal.

27. The circuit of claim 26, wherein the variable current circuit is coupled to increase the bleeder current as the input voltage decreases, and coupled to decrease the bleeder current as the input voltage increases.

28. The circuit of claim 27, wherein the current scaling circuit includes a current scale resistor coupled to output the current scale signal in response to the input voltage.

29. The circuit of claim 28, wherein the variable current circuit includes a first transistor having a first terminal coupled to one of the first and second input terminals of the driver circuit, and a second terminal coupled to another one of the first and second input terminals of the driver circuit to receive the current scale signal, wherein a control terminal of the first transistor is coupled to an output terminal of an operational amplifier, and wherein the operational amplifier has an inverting input terminal coupled to receive the input voltage, and a non-inverting input terminal coupled to receive a reference voltage.

30. The circuit of claim 26, wherein the variable current circuit is coupled to increase the bleeder current if the input voltage is lower than a threshold voltage, and coupled to decrease the bleeder current if the input voltage is equal to or greater than the threshold voltage.

* * * * *